United States Patent [19]

Litvinoff

[11] Patent Number: 4,677,896

[45] Date of Patent: Jul. 7, 1987

[54] RESCUE VEHICLE

[76] Inventor: Jerome S. Litvinoff, 6536 Crystalaire Dr., San Diego, Calif. 92120

[21] Appl. No.: 682,078

[22] Filed: Dec. 17, 1984

[51] Int. Cl.[4] ..... F41H 5/12

[52] U.S. Cl. ..... 89/36.08; 296/19

[58] Field of Search ..... 89/40.03, 36.08; 296/19

[56] References Cited

U.S. PATENT DOCUMENTS

| | | | |
|---|---|---|---|
| 1,203,962 | 11/1916 | Bellamore | 89/40.03 |
| 1,485,605 | 3/1924 | Glatter | 89/40.03 |
| 1,504,949 | 8/1924 | Gibbs . | |
| 1,597,569 | 8/1926 | Barringer . | |
| 1,780,518 | 11/1930 | Danker . | |
| 2,100,043 | 11/1937 | Runaya | 89/36 |
| 2,361,570 | 10/1944 | Riboud | 89/36.08 |
| 2,382,862 | 8/1945 | Davis | 89/36 |
| 3,478,643 | 11/1969 | Forsyth et al. | 89/36 |

FOREIGN PATENT DOCUMENTS

| | | | |
|---|---|---|---|
| 2451870 | 5/1976 | Fed. Rep. of Germany | 89/36.08 |

*Primary Examiner*—Harold D. Whitehead

*Attorney, Agent, or Firm*—Brown, Martin, Haller & Meador

[57] ABSTRACT

A land rescue vehicle equipped to safely recover wounded or injured personnel or valuable equipment while under hostile fire is disclosed. A self-propelled vehicle is equipped with an armored body shell which extends downwardly to near ground level and substantially encloses the vehicle wheels to form a shielded space beneath the vehicle. An entry panel forming a portion of the vehicle shell at the front of the vehicle is selectively opened and closed to permit positioning the vehicle over an injured person and within the shielded space. Trap doors in the floor of the vehicle body provide passage from the shielded space to the safety of the interior of the vehicle for transport of the rescued person.

3 Claims, 5 Drawing Figures

RESCUE VEHICLE

BACKGROUND OF THE INVENTION

This invention relates to rescue vehicles, and more particularly, to a land vehicle for recovering and transporting wounded or injured personnel to safety when opposed by hostile fire.

In troop combat situations it is advantageous to be able to recover wounded or injured personnel who have fallen in locations exposed to enemy fire but where such fire is not of such nature and intensity has to deny the area to rescue forces. Similar situations arise in cases of civil strife or criminal activity. Street fighting is typical of the former, while snipper and blockaded armed criminals are examples of the latter circumstances. It is also desirable to recover equipment and supplies safely while under enemy fire.

The usually available military, police or ambulance vehicles are too vulnerable to even small arms fire to be capable of making a safe and effective rescue and transit. In addition, no vehicle known to the applicant provides protection to the injured person and rescue personnel while effecting the recovery under fire. A vehicle is needed that can provide an effective shield for personnel that would otherwise be completely exposed to enemy gunfire during the rescue, permit rapid recovery of the injured or wounded, and safe transportation to a secure area. Applicant's invention accomplishes these and other functions.

SUMMARY OF THE INVENTION

According to the invention, a self-propelled land vehicle has been devised to effect the safe and rapid rescue of injured personnel or the recovery of valuable materials in the face of hostile gunfire. The vehicle is provided with an armor body shell the sides and ends of which extend downwardly to near ground level and substantially enclose the vehicle wheels to form a shielded space free from attack beneath the vehicle. A panel forming a portion of the body shell at the front of the vehicle may be selectively raised and lowered from within the vehicle. When the panel is raised, the vehicle may be positioned over the person on the ground to be rescued. When this is accomplished the panel is lowered so that recovery can be accomplished within the protection afforded by the vehicle armor and including the shielded space beneath it. Trap doors forming a portion of the floor of the vehicle permit ready passage from the shielded space to the interior of the vehicle.

An advantage of the invention is the provision of a new and improved rescue vehicle for the safe recovery of injured personnel under hostile fire conditions. The design of the vehicle permits rapid rescue. Provision is made for minimal interference of vehicle travel when not engaged in rescue activity. The vehicle and its rescue features are easily operated so as to require a minimum of training and experience to be effective. These and other attendant advantages of the invention will become more apparant upon a reading of the following detailed description together with the drawings, in which like reference numerals refer to like parts throughout.

DETAILED DESCRIPTION OF THE DRAWINGS

Figure 1:
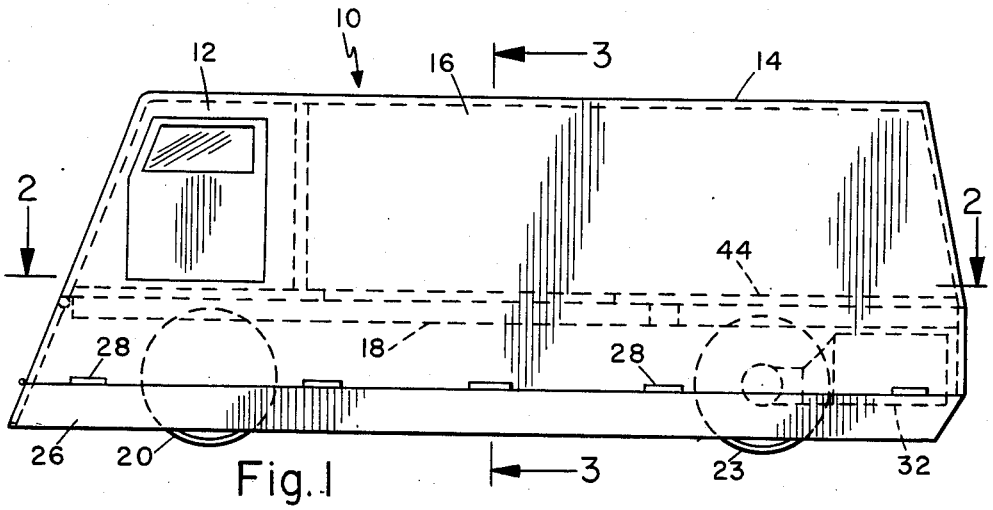
FIG. 1 is a side elevation view of the vehicle.
Figure 2:
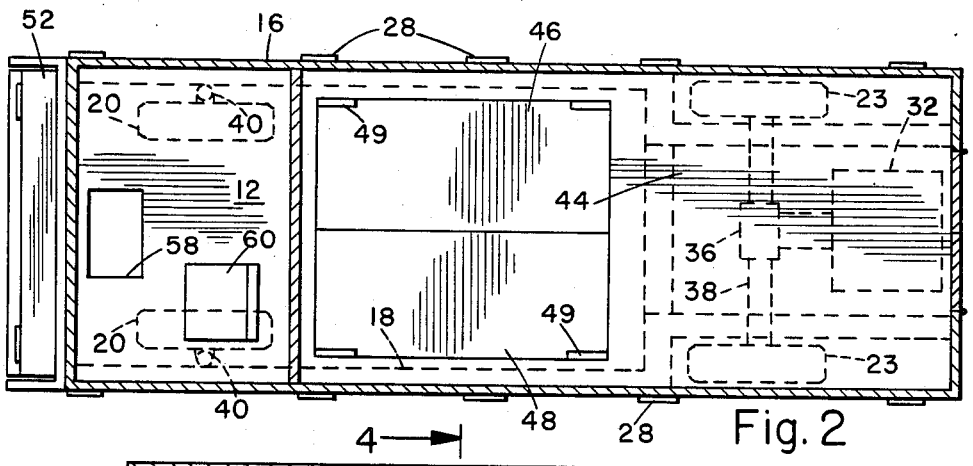
FIG. 2 is a sectional view taken on line 2—2 of FIG. 1.
Figure 3:
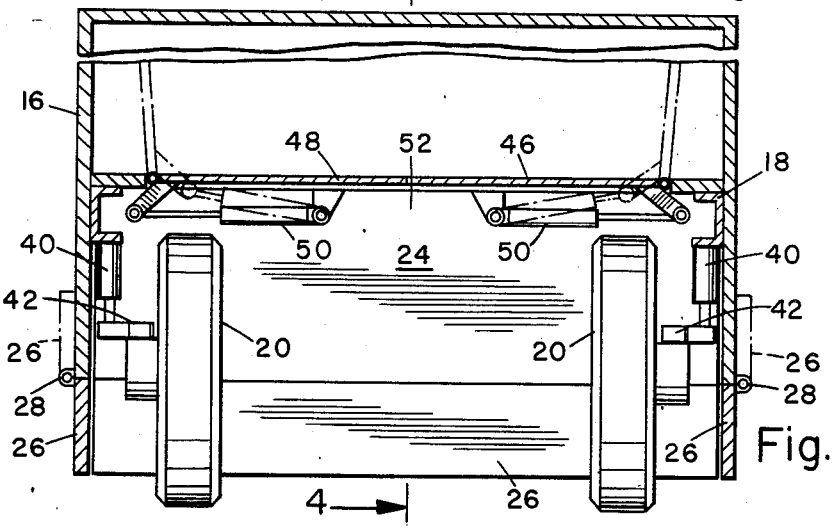
FIG. 3 is an enlarged sectional view taken on line 3—3 of FIG. 1.

The configuration and general arrangement of the illustrated embodiment of the rescue vehicle 10 is depicted in FIGS. 1 and 2. The vehicle has a cab 12 and a transport compartment 14 contained within a vehicle body shell 16, all supported on a vehicle frame 18. The shell 16 is of an armor construction to be impervious to small arms and lighter weapon fire. The shell 16 extends downwardly at the front, rear and sides of the vehicle 10 to near ground level and substantially encloses the vehicle front wheels 20 and rear wheel 23 to form a shielded space 24 beneath the vehicle as illustrated in FIG. 3. The lower periphery of the shell 16 terminates in shell skirt sections 26 which are joined to the shell by hinges 28. This design permits the skirt sections 26 to be rotated upwardly and folded against the shell 16 to facilitate vehicle movement when it is not employed in a rescue mission.

To provide a clear vehicle underbody in way of the shielded space 24 forward of the rear wheels 23, the vehicle 10 is propelled by a rear-mounted engine 32 which drives the rear wheels 23 through a transmission assembly 34, differential 36, and rear axel 38. As depicted in FIG. 3, a front suspension means 40 supports the frame 18 on the front wheels 20. Front wheel steering is provided by any suitable means represented by the steering knuckles 42.

The outline of interior of the transport compartment 14 is illustrated in FIGS. 1 and 2. It is a space essentially free of interior appointments that would interfere with a rapid recovery operation. The floor of 44 of the compartment includes two rectangularly spaced trap doors 46 and 48 located at the compartment forward end and a fixed passenger area to the rear. The doors meet at the center line of the vehicle and rotate on hinges 49 into the interior of the compartment 14. The doors 46 and 48 occupy approximately one-half the length of compartment 14 in order to provide maximum access to bring a prone injured person into the compartment 14 from the shielded space 24. As illustrated in FIG. 3, the doors 46 and 48 are further supported and operated by power actuators 50 controlled by suitable control means not shown. Alternatively, the trap doors 46 and 48 may be manually opened since they need not be of heavy construction as they are protected by the armor shell 16. Additional access openings, not shown, may be provided in the sides or rear of the compartment 14 for disembarking rescued personnel.

Figure 4:
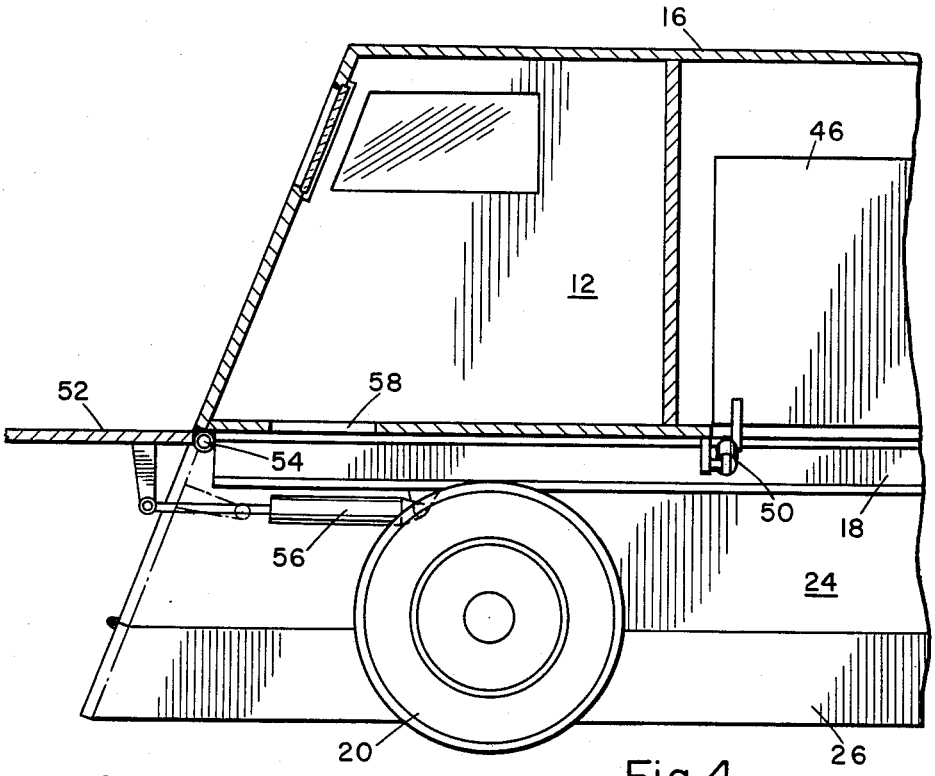
FIG. 4 is a sectional view taking on line 4—4 of FIG. 3.

Rescue vehicle features for embarking an injured person on the ground via the shielded space 24 are further illustrated in FIG. 4. At the front end of the vehicle 10, the body shell 16 has an entry panel 52 formed therein. The panel 52 is attached to the vehicle frame 18 by hinges 54 so that it may be raised as indicated to allow the vehicle 10 to be driven over an injured person when instituting recovery. The panel 52 is raised and lowered by a hydraulic actuator mechanism 56 is controlled from within the cab 12 by suitable remote means not shown. As illustrated in FIGS. 2 and 4, a window 58 is installed in the floor of the cab 12 so that a vehicle operator in the driver's seat 60 may observe the person to be rescued while positioning the vehicle 10 over him.

OPERATION

Figure 5:
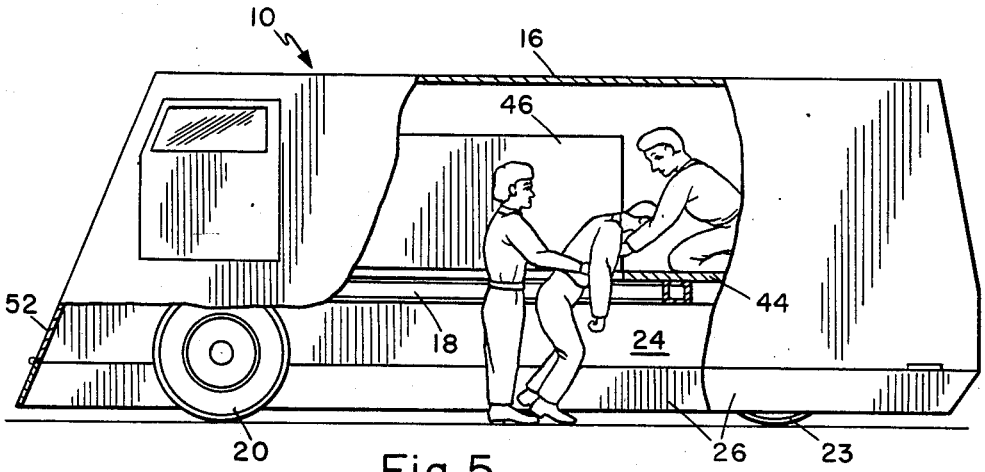
FIG. 5 is a side elevation view of the vehicle, partially cut away, to show a rescue in progress.

Operation of the rescue vehicle 10 will be described with reference to FIGS. 4 and 5. To make a rescue, the vehicle 10 arrives at the location of the injured person with the armored skirts 26 lowered and with the entry panel 52 in the raise positioned. Utilizing the window 58 the operator of the vehicle positions it over the person to be rescued, stops and lowers the panel 52. Further injury to the person to be rescued by hostile fire is prevented by the shielding of the armored vehicle body shell 16. At the site, or during the approach, either one or both of the trap doors 46 and 48 may be opened. The injured person is then raised on a stretcher or assisted through the trap door opening in the floor of the transport compartment, and moved to the after end of the compartment. The trap doors are then closed, and the vehicle 10 is ready to transport the rescued person to a safer area.

While the present invention has been illustrated and described by means of a particular embodiment and application, it is to be understood that changes and modifications may be made thereto without departing from the spirit and scope of the invention as defined in the appended claims.

The invention having been described, what is claimed is:

1. A rescue vehicle comprising:

a vehicle body having a front and rear end, sides, roof and floor defining at least one internal vehicle compartment;

vehicle wheels rotatably mounted on the vehicle body;

drive means within the vehicle body for driving the wheels to propel the vehicle;

the vehicle body having an armor construction exterior shell;

the shell having armored front, rear and side skirt sections which extend downwardly around the periphery of the body from the floor level to a level close to the ground level and enclose said vehicle wheels to from a shielded space beneath the vehicle;

the front, rear and side skirt sections each terminating in retractable flaps which are moveable between a lowered position in which they extend downwardly close to the ground level and a raised position in which they are raised above the ground;

the front flap covering a front entry opening when lowered, the front entry opening being of dimensions sufficient for driving the vehicle forwardly over a prone, injured person in front of the vehicle with some clearance;

control means within the vehicle body for selectively raising and lowering the front flap;

at least one trap door in said floor for providing access from the ground beneath said floor to the internal compartment;

the vehicle floor at the front end of the vehicle having no downward projections and being raised above ground level by a sufficient distance to enable the vehicle to be driven forwardly with some clearance over a prone, injured person until the person is positioned beneath the trap door; and at least one window opening in the floor at the forward end of the vehicle adjacent a driver's position for allowing the driver to view the ground beneath the vehicle and position the vehicle over an injured person.

2. The vehicle as claimed in claim 1, wherein the drive means is in the rear end of the vehicle body.

3. The vehicle as claimed in claim 1, wherein the flaps are hinged to the remainder of said downward skirt portions and are foldable upwardly into their raised positions.

* * * * *

UNITED STATES PATENT AND TRADEMARK OFFICE

CERTIFICATE OF CORRECTION

PATENT NO. : 4,677,896

DATED : July 7, 1987

INVENTOR(S) : Jerome S. Litvinoff

It is certified that error appears in the above-identified patent and that said Letters Patent is hereby corrected as shown below:

Claim 1, column 4, line 7, the word "from" should be --form--;

Signed and Sealed this

Fifteenth Day of December, 1987

*Attest:*

*Attesting Officer*

DONALD J. QUIGG

*Commissioner of Patents and Trademarks*